US006817343B1

(12) United States Patent
Greco et al.

(10) Patent No.: US 6,817,343 B1
(45) Date of Patent: Nov. 16, 2004

(54) ELECTRONIC CONTROL SYSTEM FOR FUEL SYSTEM PRIMING

(75) Inventors: Luca Greco, Altamura (IT); Amy M. Hess, Metamora, IL (US); Alan R. Stockner, Metamora, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 10/421,993

(22) Filed: Apr. 23, 2003

(51) Int. Cl.[7] ..... F02M 37/08
(52) U.S. Cl. ..... 123/497; 123/446; 123/456
(58) Field of Search ..... 123/497, 446, 123/456, 179.17, 198 D

(56) References Cited

U.S. PATENT DOCUMENTS

| | | | | |
|---|---|---|---|---|
| 4,553,697 A | | 11/1985 | Nothen et al. | |
| 5,513,614 A | * | 5/1996 | Gras et al. | 123/497 |
| 5,572,974 A | | 11/1996 | Wakeman | |
| 5,598,817 A | | 2/1997 | Igarashi et al. | |
| 5,878,718 A | | 3/1999 | Rembold et al. | |
| 5,918,578 A | | 7/1999 | Oda | |
| 6,253,735 B1 | * | 7/2001 | Miyajima | 123/456 |
| 6,253,739 B1 | * | 7/2001 | Golomb et al. | 123/509 |
| 6,269,801 B1 | * | 8/2001 | Channing | 123/516 |
| 6,314,947 B1 | * | 11/2001 | Roche | 123/525 |
| 6,398,119 B1 | | 6/2002 | Duffer et al. | |
| 6,463,908 B1 | | 10/2002 | Gibson et al. | |
| 6,543,425 B2 | * | 4/2003 | Mayer et al. | 123/495 |
| 6,609,500 B2 | * | 8/2003 | Ricco et al. | 123/446 |
| 2001/0039944 A1 | | 11/2001 | Braun et al. | |

FOREIGN PATENT DOCUMENTS

| | | |
|---|---|---|
| EP | 0 643 219 A1 | 3/1995 |
| EP | 0 643 219 B1 | 1/1998 |

* cited by examiner

*Primary Examiner*—Weilun Lo
(74) *Attorney, Agent, or Firm*—Liell & McNeil

(57) ABSTRACT

Particularly in a relatively large engine that has been inactive for a substantial period of time at a cold temperature, the pressure within a fuel system may decrease. Prior to initiation of engine start-up, fuel pumps that are operably coupled to the engine cannot pressurize and/or circulate fuel within the fuel system. Thus, the time required to supply the high pressure lines with fuel pressure sufficient to start and maintain the engine can be unreasonably delayed. In order to decrease the delay in starting the engine, the present invention includes an electronic control module that includes a priming algorithm. The priming algorithm is operable to activate an electrically powered fuel pump when a fuel system is in an unprimed state. The electronic control module is in communication with at least one sensor that is operable to sense the state of the fuel system.

20 Claims, 2 Drawing Sheets

ELECTRONIC CONTROL SYSTEM FOR FUEL SYSTEM PRIMING

TECHNICAL FIELD

The present invention relates generally to fuel systems, and more specifically to a method of priming fuel systems using an electronic control system.

BACKGROUND

It is known in the art that when an engine is shut down and allowed to remain inactive for a period of time, fuel pressure within the engine's fuel system will decay. In addition, when the engine has remained inactive for a relatively long period or when the engine is shut down hot and allowed to cool to ambient air temperature on a cold day, the fuel will contract allowing vapor and/or air bubbles to form within the fuel system. Further, when the fuel system is drained for maintenance purposes, the fuel within the system must be replaced. Thus, in order to re-start the engine, the fuel system must be primed with fuel, and the pressure within the fuel system must be raised.

In many fuel systems, the pressure within the fuel system is raised by a high pressure pump. A fuel transfer pump supplies the fuel to the high pressure pump, and the high pressure pump pressurizes the fuel and delivers it to a common rail. It is known in the art that, in order to effectively operate the high pressure pump, the fuel flowing from the fuel transfer pump into the high pressure pump must be at a threshold inlet pressure. Once the fuel enters the high pressure pump, the high pressure pump must further raise the pressure of the fuel to an outlet valve opening pressure in order to permit the flow of fuel from the high pressure pump to the common rail. The high pressure pump can then prime the common rail with fuel and raise the pressure of the common rail to injection pressures.

Often, the high pressure pump and the fuel transfer pump are operably coupled to the engine. Thus, once engine cranking has begun, it takes time for the fuel transfer pump to raise the pressure of the fuel being supplied to the high pressure pump to the threshold inlet pressure. Moreover, once engine cranking has begun, it takes time for the high pressure pump to create pressure sufficient to open the outlet valve of the high pressure pump. Because the priming of the common rail is dependent on the output of the high pressure pump which in return is dependent on the output of the fuel transfer pump, the engine crank time is increased by the high pressure pump and the fuel transfer pump.

Over the years, engineers have developed various strategies for priming a fuel system and reducing engine cranking time. One such strategy is the use of electrically powered priming pumps. For instance, the fuel system shown in U.S. Pat. No. 5,878,718, issued to Rembold et al., on Mar. 9, 1999, includes an electrically powered fuel transfer pump that also acts as the priming pump. Upon initiation of the engine, the Rembold pump is electrically activated and begins supplying fuel to a mechanical high pressure pump and fuel common rail. However, if pressure sensors sense that the fuel system is in an unprimed state, an electronically controlled valve will be activated in order to increase the delivery of the fuel transfer pump. The fuel transfer pump will then act as the priming pump and deliver fuel to the common rail via a fuel connection line that bypasses the high pressure pump that is operably coupled to the engine. By bypassing the high pressure pump, fuel can be delivered to the common rail without being hindered by the high pressure pump. When the high pressure pump is fully activated and is supplying high pressure fuel to the common rail, the electronically controlled valve is returned to its normal engine operating position, reducing the delivery from the electrically powered pump. The electrically powered pump will act as the fuel transfer pump and deliver fuel to the common rail via the high pressure pump, rather than by bypassing the high pressure pump.

Although the Rembold pump illustrates one strategy for reducing engine crank time and priming the fuel system, there is room for improvement. For instance, in larger engines, such as those used in conjunction with generators, marine applications, and locomotives, it is often inefficient and impractical to use an electrically-powered fuel transfer pump. The larger the engine, the larger the fuel transfer pump, and thus, the more energy required to operate the fuel transfer pump. Often, hand priming pumps or manually activated priming pumps are used. Further, for engines with specific applications, such as engines used with generators in case of emergencies, the system should be able to prime the common rail prior to initiation of the engine start-up in order to assure relatively quick engine starts. For instance, in a hospital where the primary power source is interrupted, the engine used in conjunction with the generator must be able to start operating and providing mechanical energy to the generator within a specified short period in order to maintain the operation of the hospital's equipment and to meet federal regulations. The Rembold pump that is not activated until initiation of the engine start cannot assure a primed common rail in an inactive engine.

The present invention is directed to overcoming one or more of the problems set forth above.

SUMMARY OF THE INVENTION

In one aspect of the present invention, a fuel system includes a first fuel pump that is electrically powered and in communication with an electronic control module. A second fuel pump is operably coupled to an engine. The electronic control module includes a priming algorithm that is operable to activate the first fuel pump when the fuel system is in an unprimed state.

In another aspect of the present invention, a control system includes an electronic control module in communication with at least one sensor operable to sense a state of the fuel system. The electronic control module includes a priming algorithm that is operable to activate an electrically powered fuel pump when the state of the fuel system is unprimed.

In yet another aspect of the present invention, a fuel system is primed by first determining whether the fuel system is in an unprimed state. If the fuel system is in an unprimed state, an electrically powered pump is activated via an electronic control module.

DETAILED DESCRIPTION

Figure 1:
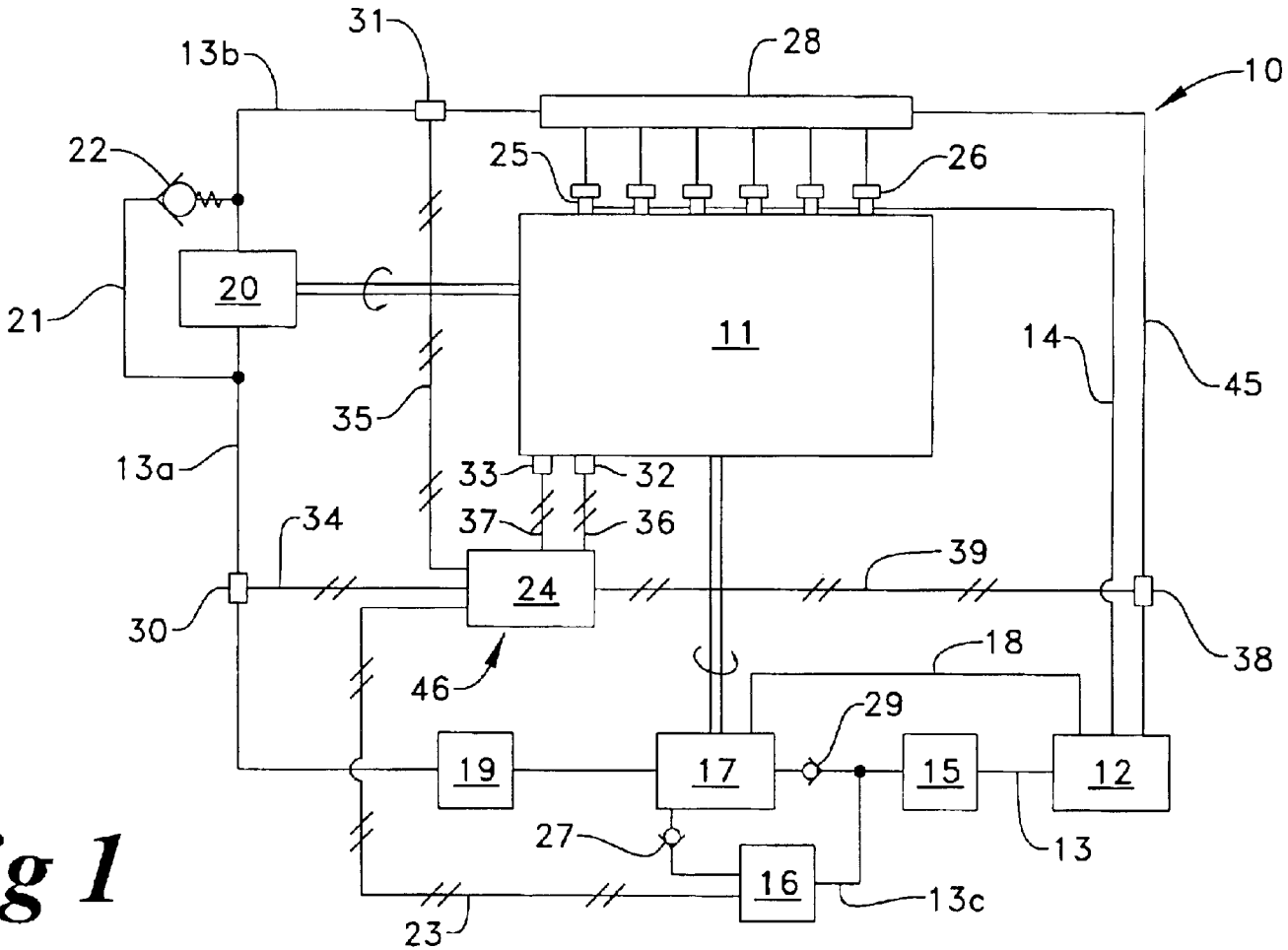
FIG. 1 is a schematic representation of a fuel system, according to the present invention.

Referring to FIG. 1, there is shown a schematic representation of a fuel system 10, according to the present invention. The fuel system 10 circulates fuel between a fuel tank 12 and an engine 11 via a supply line 13 and a return line 14. Within the fuel supply line 13, there are at least two pumps, and preferably three pumps. A first fuel pump, being priming pump 16, is electrically powered and is in communication with an electronic control module 24 via a pump communication line 23. The priming pump 16 is positioned in a priming portion 13*c* of the supply passage 13. A second fuel pump, being fuel transfer pump 17, is operably coupled to the engine 11 via a mechanical linkage that could include gears and rotating shafts. Although a pressure regulator could be included in a separate housing downstream from fuel transfer pump 17, the present invention illustrates the fuel transfer pump 17 including a pressure regulator of a conventional type fluidly connected to the fuel tank 12 via regulator return line 18. The pressure regulator regulates the delivery of fuel from the fuel transfer pump 17 and can assist in removing air from the fuel.

The fuel transfer pump 17 and the priming pump 16 are positioned parallel to one another such that fuel drawn from the fuel tank 12 will pass through either the fuel transfer pump 17 or the priming pump 16 after passing through a first fuel filter 15. Although the fuel transfer pump 17 and the priming pump 16 preferably share a portion of the supply line 13 extending from the fuel tank 12, it should be appreciated that each pump 17 and 16 could be fluidly connected to the fuel tank 12 via its own supply line with its own fuel filter. In the preferred embodiment, the output from priming pump 16 bypasses the pumping portion of fuel transfer pump 17; however, the fluid connection itself is located within the housing for fuel transfer pump 17. It should further be appreciated that the priming portion 13*c* could connect with the supply line l3*a* upstream from the fuel transfer pump 17 rather than via a portion of the fuel transfer pump 17. A first valve 27 and a second valve 29 prohibit the reverse flow of fuel to and from either the priming pump 16 and the fuel transfer pump 17. Although the valves 27 and 29 could be various types, the present invention illustrates valves 27 and 29 as conventional check valves. The first valve 27 is positioned within the priming portion 13*c* and prevents the back flow of fuel into the priming portion 13*c* of the supply line 13. The second valve 29 is positioned upstream from the fuel transfer pump 17, and prevents the back flow of fuel through the upstream portion 13*a* of the supply line 13.

A third fuel pump, being high pressure pump 20, is positioned downstream from both the fuel transfer pump 17 and the priming pump 16. The third fuel pump 20 is operably coupled to the engine 11 via a conventional mechanical linkage that could include gears and rotating shafts. The high pressure pump 20 includes an outlet valve that will allow fuel to flow from the high pressure pump 20 when the pressure within the high pressure pump 20 has reached an outlet valve opening pressure. The high pressure pump 20 also includes a threshold inlet pressure at which the pump 20 operates effectively. The threshold inlet pressure is the pressure of the fuel flowing into the high pressure pump 20. A second fuel filter 19 providing an intense filtration of the fuel is positioned within the supply line 13 downstream from the fuel transfer pump 17 and the priming pump 16 and upstream from the high pressure pump 20. Although three pumps are preferred, it should be appreciated that the present invention also contemplates a fuel system with more than three pumps or with only two fuel pumps. In the fuel system with two pumps, an electrically powered fuel transfer pump is appropriately plumbed and controlled to circulate fuel to the high pressure pump 20 and also serve as the priming pump of the present invention.

The fuel system 10 preferably includes a bypass line 21 that fluidly connects an upstream portion 13*a* of the supply line 13 to a downstream portion 13*b* of the supply line 13. Because the upstream portion 13*a* and the downstream portion 13*b* are separated by the high pressure pump 20, fuel flowing through the bypass line 21 bypasses the high pressure pump 20. A check valve 22 is positioned within the bypass line 21. The check valve 22 is preferably biased to the closed position by a spring. However, it should be appreciated that the valve 22 could be of various types and of varying complexity. Those skilled in the art will also appreciate that in an alternative version, the affect of check valve 22 and bypass line 21 could be incorporated into high pressure pump 20 such that the high pressure pump would permit through flow when the pump is not working and the pressure differential corresponds to an equivalent of check valve 22. Fuel will flow to the bypass line 21 from either the priming pump 16 or the fuel transfer pump 17 via the upstream portion of supply passage 13*a*. When fuel pressure flowing into the bypass line 21 from the upstream portion of the supply passage 13*a* is greater than the fuel pressure in the downstream portion of the supply passage 13*b* and the bias of the spring, the check valve 22 will open and fuel can flow into the downstream portion 13*b*. However, when the pressure within the downstream portion 13*b* is greater than pressure within the upstream portion 13*a*, the check valve 22 will remain closed. Both the priming pump 16 and the fuel transfer pump 17 can provide sufficient pressure within the bypass line 21 to open the valve 22 when the high pressure pump 20 has not yet begun producing output flow. It should be appreciated that the bypass line 21 could be connected to the downstream portion 13*b* in any conventional manner, including not limited to a junction box including a conventional T-connection and a safety valve.

The downstream portion 13*b* of the supply portion 13 is fluidly connected to the common rail 28. The fuel within the common rail 28 is supplied to the plurality of fuel injectors 25 via accumulators 26. Each fuel injector 25 preferably is in fluid communication with an accumulator 26 that isolates the injector 25 from pressure spikes. However, it should be appreciated that accumulators 26 are not necessary in the fuel system 10. Although the present invention is illustrated as including six fuel injectors 25 and one common rail 28, it should be appreciated that the fuel system could include more than one common rail and include any number of fuel injectors. The fuel injectors 25 inject fuel into the engine cylinders; fuel that is not injected is returned back to the fuel tank 12 via the return line 14 for re-circulation through the fuel system 10. If needed, an air starter (not shown) is attached to the engine 11 to pump compressed air into the engine cylinders during the starting of the engine 11. Those skilled will appreciate that electric start is also contemplated. It should be appreciated that an air check valve may be positioned within the common rail 28, or at a high elevation point within the fuel system 9, in order to evacuate any vapor and/or air bubbles from the fuel system. It should further be appreciated that the air and/or vapor could be pushed through a plurality of fuel injectors 25 and into the engine cylinder, or back to tank, during priming.

Preferably, the downstream portion 13*b* of the supply line 13 includes double walled lines. The pressurized fuel flows within a space defined by a first wall. If the pressurized fuel leaks through the first wall, the fuel can flow between the first wall and the second wall. The fuel that has remained within the first wall can travel to the fuel injectors 25 for injection into the engine cylinders. However, any fuel that has leaked in between the first and second walls will drain through a leakage line 45. Positioned within the leakage line 45 is a wet sensor 38 that is preferably in communication with the electronic control module 24 via communication line 39. If the wet sensor 38 senses moisture, the wet sensor 38 will communicate such to the electronic control module 24, and the electronic control module 24 will alert the operator that there is a high pressure line leak. It should also be appreciated that, in order to sense leakage within the fuel system 9, the wet sensor 38 could also be in fluid communication with other areas of high pressure within the fuel system 9, such as the high pressure pump 20. It should be appreciated that the present invention contemplates a fuel system without double walled high pressure lines and a wet sensor.

A control system 46 includes at least one sensor positioned with the fuel system 10 in order to sense the condition of the fuel system 10. There can be a pressure sensor 30 positioned upstream from the high pressure pump 20, another pressure sensor 31 positioned downstream from the high pressure pump 20, an engine speed 32 sensor and an air starter condition sensor 33 in communication with the electronic control module 24 via the upstream communication line 34, downstream communication line 35, engine speed communication line 36, and an air starter communication line 37, respectively. Because the pressure sensor 31 is positioned downstream from the high pressure pump 20, the pressure sensor 31 is sensing the pressure within a high pressure portion of the common rail 28 of the fuel system 10. It should be appreciated that the sensor 31 can be attached to the common rail 28. Because the pressure sensor 30 is positioned upstream from the high pressure pump 20, the sensor 30 is sensing the pressure within the low pressure portion of the fuel system 10. In the present invention's simplest version, the control system 46 only includes the upstream pressure sensor 30. However, in a more sophisticated version of the present invention, the control system 46 can include fuel condition sensors in addition to the sensors 30, 31, 32, and 33 in the illustrated example.

Figure 2:
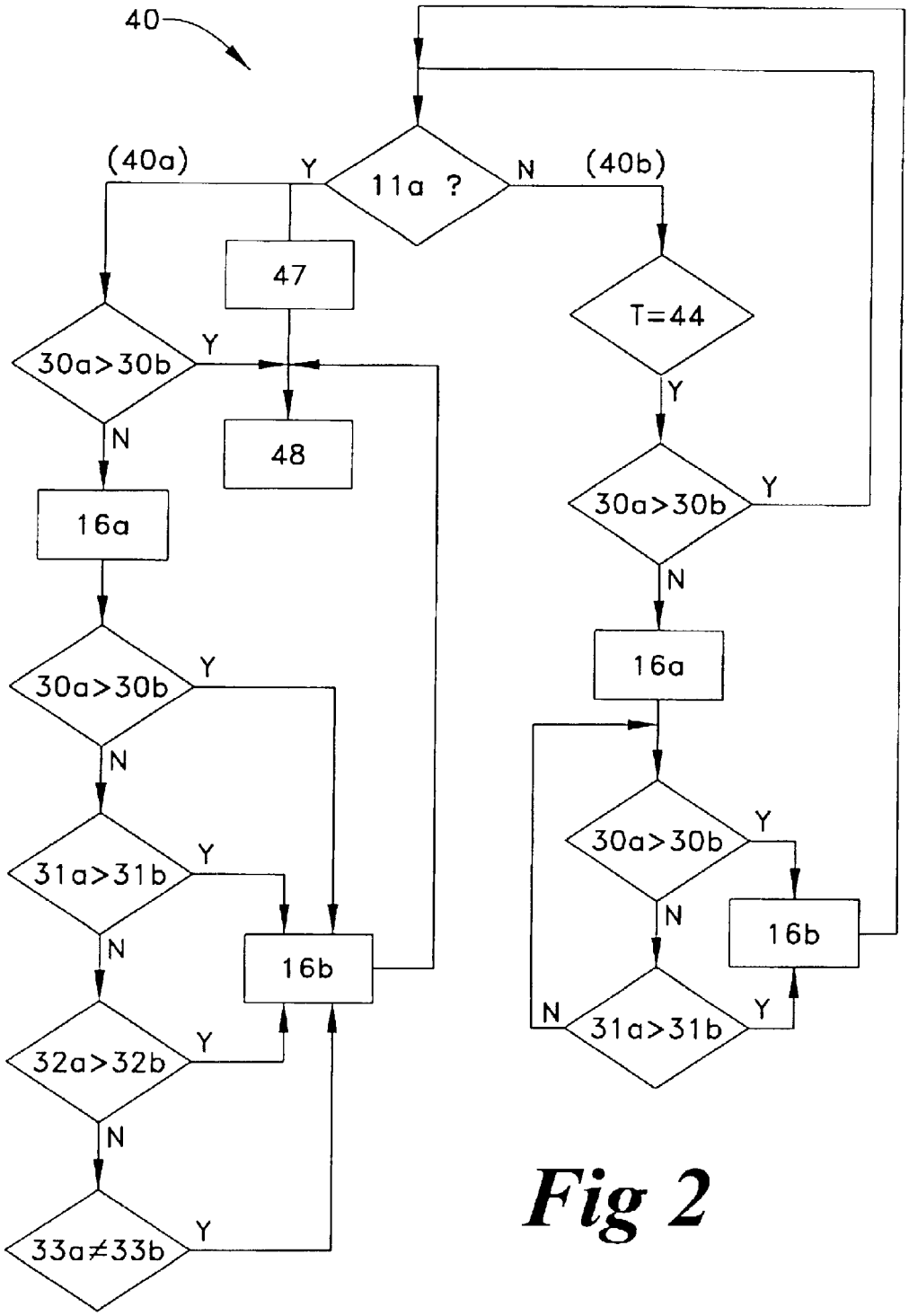
FIG. 2 is a flow chart of a priming algorithm, according to the present invention.

Referring to FIG. 2, there is shown a flow chart representing a priming algorithm 40, according to the present invention. The electronic control module 24 includes a priming algorithm 40 being operable to activate the priming pump 16 when the fuel system 10 is in an unprimed state. For purposes of the present invention, the fuel system 10 is in an unprimed state when the fuel system pressure is below the threshold inlet pressure required for effective operation of the high pressure pump 20. If the pressure is below the threshold inlet pressure, air and/or vapor bubbles could be trapped within the fuel system 10. However, if the pressure is above the threshold inlet pressure, and thus, the fuel system 10 is in the primed state, generally, the fuel system 10 will also be free of air and/or vapor bubbles.

The priming algorithm 40 preferably includes an engine activation mode 40*a* and an inactive engine mode 40*b*, although it need not include the inactive engine mode 40*b*. When the priming algorithm 40 is in the engine activation mode 40*a*, the priming algorithm 40*a* is activated upon engine start-up initiation 11*a*. When the priming algorithm 40 is in the inactive engine mode 40*b*, the priming algorithm 40*b* is activated upon engine de-activation. Thus, the priming algorithm 40 will first determine whether engine start-up has been initiated. If engine start-up has been initiated, engine cranking 47 will preferably begin. However, it should be appreciated that the present invention contemplates systems in which the engine cranking is delayed until after the priming pump 16 has completed its operation.

While the engine 11 is cranking, the pressure sensor 30 will sense the pressure upstream from the high pressure pump 20, and communicate such to the electronic control module 24. The priming algorithm 40*a* determines whether the fuel system 10 is in the unprimed state, at least in part, by comparing the sensed upstream pressure 30*a* with a predetermined upstream pressure 30*b*. The present invention contemplates, in a more sophisticated version, other conditions, such as the downstream pressure, being sensed to determine whether the fuel system 10 is in the unprimed state. The predetermined upstream pressure 30*b* correlates to the threshold inlet pressure of the high pressure pump 20. Those skilled in the art will appreciate that the predetermined upstream pressure 30*b* may vary depending on the size and type of high pressure pump 20 included within the fuel system 10. If the sensed upstream pressure 30*a* is less the predetermined pressure 30*b*, the fuel system 10 has fallen to a pressure that is insufficient to effectively operate the high pressure pump 20. Thus, the fuel system 10 is in the unprimed state, and the priming pump 16 will be activated 16*a*. If the sensed pressure 30*a* is greater than the predetermined pressure 30*b*, the fuel system 10 is a primed state, and the engine cranking time will be reasonable in order to start the engine 11.

If the priming pump 16 has been activated, the priming algorithm 40*a* will continue to sense fuel system conditions in order to determine when the fuel system 10 reaches the primed state. The priming algorithm 40*a* will again compare the sensed upstream pressure 30*a* with the predetermined upstream pressure 30*b*. Further, the priming algorithm 40*a* will compare a sensed downstream pressure 31*a* with a predetermined downstream pressure 31*b*. The predetermined downstream pressure 31*b* can also be the threshold inlet pressure required for effective operation of the priming pump 16. If at least one of the upstream pressure 30*a* and the downstream pressure 31*a* is greater than the predetermined upstream or downstream pressure 30*b* and 31*b*, respectively, the priming algorithm 40*a* will de-activate 16*b* the priming pump 16. However, the priming algorithm 40*a* will also preferably sense the engine speed via the engine speed sensor 32 and the air starter condition via the air starter sensor 33. The priming algorithm 40*a* will compare the sensed engine speed 32*a* and the sensed air starter condition 33*a* with the predetermined engine speed 32*b* and the predetermined air starter condition 33*b*, respectively. The predetermined engine speed 32*b* is the speed of the engine 11 that is sufficient to power the fuel transfer pump 17 to produce output at the threshold inlet pressure. The predetermined condition 33*b* of the air starter is activated. If the sensed engine speed 32*a* is greater than the predetermined engine speed 32*b*, the priming pump 16 will be de-activated 16*b*. Similarly, if the sensed air starter condition 33*a* is different than the predetermined air starter condition 33*b*, the priming pump 16 will be deactivated 16*b*. Thus, the fuel system 10 is in the primed state when at least one of the sensed upstream pressure 30*a*, the sensed downstream pressure 31*a*, and the sensed engine speed 32*a* is greater than the predetermined upstream pressure 30*b*, the predetermined downstream pressure 31*b*, and the predetermined engine speed 32*b*, respectively, or the sensed air starter condition 33*a* is different than the predetermined air starter condition 33*b*.

If the sensed pressures 30*a* and 31*a* and the sensed engine speed 32*a* are less than the predetermined pressures 30*b* and 31*b* and the predetermined engine speed 32*b*, and the air starter condition 33*a* is different than the predetermined air starter condition 33*b*, the fuel system 10 is still in the unprimed state, and the priming pump 16 will remain active. The priming algorithm 40*a* will continue to compare the sensed fuel system conditions with the predetermined fuel system conditions until it determines that the fuel system 10 is in the primed state. It should be appreciated that in order to determine whether the fuel system 10 is in the primed state, the present invention contemplates sensing and comparing fuel system conditions in addition to, or other than, the above-listed conditions. Further, in a simpler version of the present invention, only one of the upstream pressure, downstream pressure, engine speed and air starter condition can be sensed to determine whether the fuel system is in the unprimed state.

When the priming algorithm 40 senses that the engine 11 has been de-activated, the inactive engine mode 40*b* of the priming algorithm 40 will begin monitoring the time the engine 11 remains inactive. After a predetermined time interval 44 when the engine is de-activated, the priming algorithm 40 is operable to determine whether the fuel system 10 is in the unprimed state. The length of predetermined time interval 44 can be a design choice, although the length is preferably not longer than required for the fuel system 10 to fall into the unprimed state.

The priming algorithm 40*b* will determine whether the fuel system 10 is in the primed condition by comparing the sensed upstream pressure 30*a* with the predetermined upstream pressure 30*b*. If the sensed pressures 30*a* is greater than the predetermined pressure 30*b*, the priming algorithm 40*b* will determine that the fuel system 10 is in the primed state, and the priming pump 16 will remain inactive. However, if the sensed pressure 30*a* is less than the predetermined pressure 30*b*, the priming algorithm 40*b* will activate 16*a* the priming pump 16. It should be appreciated that the present invention contemplates additional fuel system conditions, such as the downstream pressure, being sensed and compared to determined whether the fuel system 10 is in the unprimed condition. The pressure sensor 30 will continue to sense the upstream pressures 30*a*, and communicate such to the electronic control module 24. In addition, after the priming pump 16 is activated, the downstream pressure sensor 31 will also sense the downstream pressure 31*a* and compare it will the predetermined downstream pressure 31*b*. When at least one of the sensed pressures 30*a* and 31*a* exceeds the predetermined pressures 30*b* and 31*b*, the fuel system 10 is in the primed state, and the pump 16 will be de-activated 16*b*. Upon the next predetermined time interval 44, the sensors 30 and 31 will again sense the pressures within the supply line 13, and the process will repeat itself. Again, the fuel condition sensors could include additional condition sensors, or just one of the pressure sensors 30*a* or 30*b*. However, because the engine 11 remains inactive in the inactive engine mode 40*b*, the engine speed and the air starter condition will not be sensed to determine whether the fuel system 10 is in the primed state.

INDUSTRIAL APPLICABILITY

Referring to FIGS. 1 and 2, the present invention will be discussed for an internal combustion engine. Although the present invention is generally applicable to any internal combustion engine, the present invention finds specific application with relatively large engines, including but not limited to engines that are used in conjunction with electrical generators, locomotives, and marine applications.

When engine start-up is initiated, the engine cranking 47 will begin, and the engine activation mode 40*a* of the priming algorithm 40 will be activated. However, it should be appreciated that engine cranking can be delayed until after the operation of the priming pump 16, if necessary, is completed. The upstream sensor 30 senses the pressure within the upstream portion 13*a*, and communicates such to the electronic control module 24 via the upstream sensor communication line 34. The priming algorithm 40 will determine whether the fuel system 10 is in the unprimed state, at least in part, by comparing the sensed upstream pressure 30*a* with the predetermined upstream pressure 30*b*. The predetermined upstream pressure 30*b* corresponds to the threshold inlet pressure of the high pressure pump 20. Because it is known in the art that if the sensed downstream pressure 31*a* has fallen below the threshold inlet pressure, then the upstream pressure 30*a* has more than likely also fallen below the threshold inlet pressure, the present invention contemplates both the upstream and downstream portions 13*a* and 13*b* of supply line 13 being sensed in order to provide reassurance as to the state of the fuel system 10. In the illustrated example, if the sensed upstream pressure 30*a* is greater than the predetermined upstream pressure 30*b*, the fuel system 10 is in the primed state.

If the electronic control module 34 determines the fuel system 10 is in the primed state, the priming pump 16 will not be activated. Because the upstream pressure 30*a* is above the threshold inlet pressure of the high pressure pump 20, the high pressure pump 20 can begin effective operation, thereby reducing the time required for the high pressure pump 20 to raise pressure to the outlet valve opening pressure and produce output. Once the high pressure pump 20 is producing output, the common rail 28 pressure can be raised to injection pressure levels, and the engine can start 48.

However, if the sensed upstream pressure 30*a* is less than the predetermined upstream pressure 30*b*, the fuel system 10 is in the unprimed state. Although there are various reasons for the fuel system 10 being in the unprimed state, often the longer the engine 11 has been de-activated prior to engine start-up and the colder the temperature of the fuel system, the more likely the fuel system 10 will go into an unprimed state. When the fuel system 10 is in the unprimed state, the priming algorithm 40 preferably will activate the priming pump 16 via the pump communication line 23. However, it should be appreciated that if the fuel system 10 included only two fuel pumps, the priming algorithm 40 would activate an electrically powered fuel transfer pump.

The priming pump 16 will begin pumping fuel from the fuel tank 12 and through the first fuel filter 15 and the second fuel filter 19. In the illustrated example, engine cranking 47 is occurring simultaneously with the operation of the priming pump 16. However, while simultaneously operating the priming pump 16 and cranking the engine 11 may provide increased fuel flow to the fuel system 10 caused by both the priming pump 16 and the fuel transfer pump 17 output, it also requires significant amount of energy to power both the engine cranking 47 and the priming pump 16 simultaneously. A portion of the fuel will flow through the bypass line 21 around the high pressure pump 20, and another portion will flow through the upstream portion 13*a* of the supply line 13 to the high pressure pump 20. The high pressure pump 20 may not yet be sufficiently powered to create the outlet valve opening pressure in order to produce output. Thus, the fuel flowing through the bypass line 21 will be sufficient to open the check valve 22 against the pressure within the downstream portion 13*b*, and the priming pump 16 will be priming the common rail 28 with fuel by supplying fuel to the common rail 28. Thus, the priming pump 16 can supply fuel to the common rail 28 in order to evacuate vapor and/or air bubbles while also raising the pressure of the fuel system 10 to the threshold inlet pressure required for effective operation of the high pressure pump 20. In addition to an alternative to bypassing fuel around the high pressure pump 20 via the bypass line 25, the valve opening pressure of the pump outlet valve can be lowered such that the pressure created by the priming pump 16 and/or the fuel transfer pump 17 is sufficient to open the pump outlet valve. Thus, the priming pump 16 could supply fuel to the common rail 28 via the high pressure pump 20 before the high pressure pump 20 begins operating. Those skilled in the art will appreciate that the bypass line 25 and the lowered pump outlet valve opening pressure can be used in conjunction with one another or separately. If used together, fuel could simultaneously flow through the bypass line 21 and the high pressure pump 20. When the high pressure pump 20 begins producing output exceeding the predetermined downstream pressure 31*a*, the check valve 22 will close.

The upstream pressure sensor 30, the downstream pressure sensor 31, the engine speed sensor 32 and the air starter condition sensor 33 will sense their respective conditions. When at least one of the sensed upstream pressure 30*a*, the sensed downstream pressure 31*a*, and the sensed engine speed 32*a* is greater than the predetermined upstream pressure 30*b*, predetermined downstream pressure 31*b*, and the predetermined engine speed 32*b*, respectively, or the sensed air starter condition 33*a* is different than the predetermined air starter condition 33*b*, the electronic control module 24 will determine that the fuel system 10 is in the primed state. Thus, the fuel pressure within the upstream portion 13*a* of the supply line 13 is above the threshold inlet pressure of the high pressure pump 20. The priming algorithm 40 will de-activate 16*b* the priming pump 16.

Because the pressure within the upstream portion 13*a* is above the threshold inlet pressure, the high pressure pump can relatively quickly raise the pressure within the high pressure pump 20. Once the pressure reaches the outlet valve opening pressure, the outlet valve will open, and the high pressure pump 20 will supply pressurized fuel to the common rail 28. Because the common rail 28 is already above the threshold inlet pressure, any vapor and/or air bubbles trapped within the common rail 28 may be already evacuated, thereby reducing the time for the high pressure pump 20 to raise the common rail 28 to injection pressure. Once at injection pressure, the engine can start 48. Thus, because the common rail 28 can be filled with fuel while the fuel system 10 is being raised to the threshold inlet pressure, the engine cranking time is reduced.

Preferably, the priming algorithm 40 also includes the inactive engine mode 40*b*. The inactive engine mode 40*b* is activated when the engine 11 is de-activated. When the engine 11 is de-activated, the priming algorithm 40 will begin monitoring the time the engine 11 has remained inactive. Upon the predetermined time interval 44, that is the time in which the pressure within the fuel system 10 could fall into the unprimed state, the pressure sensor 30 will sense the upstream pressure 30*a*, and communicate such to the electronic control module 24 via the communication line 34. The priming algorithm 40 will compare the sensed pressure 30*a* with the predetermined upstream pressure 30*b*. If the sensed pressure 30*a* is greater than the predetermined pressure 30*b*, the fuel system 10 is in the primed state, and the priming algorithm 40 will not activate the priming pump 16. Thus, the fuel system 10 could start the engine 111 without first raising the fuel system pressure to threshold inlet valve pressure and filling the common rail 28 will fuel. The priming algorithm 40 will again compare the sensed pressure 30*a* to the predetermined pressure 30*b* after another predetermined time interval 44. It should be appreciated that the predetermined time interval 44 between the comparisons could shorten as the time the engine 11 remains inactive increases. Further, it should be appreciated that the present invention contemplates priming algorithm 40 could adjust the length of the predetermined time interval based on sensed ambient temperature. The longer the engine 11 remains inactive and the colder the ambient temperature, the greater the possibility that the fuel system 10 is in the unprimed state.

However, if the sensed pressure 30*a* is less than the predetermined pressure 30*b*, the priming algorithm 40 will activate the priming pump 16 which will draw fuel from the fuel tank 12 and deliver the same to the bypass line 21. The fuel within the bypass line 21 can open the valve 22 and flow to the common rail 28 via the downstream portion 13*b*. The fuel will be delivered to the common rail 28 in order to begin priming the common rail 28. Thus, when the engine 11 is activated 11*a*, the fuel system 10 will be in the primed condition. After the priming pump 16 is activated, the priming algorithm 40 will continue to compare the sensed pressures 30*a* and 31*a* to the predetermined pressures 30*b* and 31*b*, respectively. When at least one of the sensed pressures 30*a* and 31*a* is greater than the predetermined pressures 30*b* and 31*b*, the priming algorithm 40 will de-activate the priming pump 16. The priming algorithm 40 will again sense the upstream pressure 30*a* and compare it with the predetermined upstream pressure 30*b* upon the next predetermined time interval 44. The process will continue to repeat until the engine start-up is initiated.

The present invention is advantageous because it reduces engine cranking time by sensing when the fuel system 10 is in the unprimed state and decreasing the time it takes the fuel system 10 to reach the primed state by activating an electrically powered priming pump 16. In the preferred embodiment of the present invention, either prior to or simultaneously to engine cranking, the priming pump 16 can raise the pressure of the fuel system 10 to threshold inlet pressure and supply fuel to the common rail 28 in unprimed situations when the high pressure pump 20 is not yet producing output. Thus, effective operation of the high pressure pump 20 is not delayed by the fuel transfer pump 17, and filling the common rail 28 with fuel is not delay by the high pressure pump 20. Engine start-up time can, thus, be reduced while utilizing the mechanically-powered fuel transfer pump 17.

Moreover, mechanically-powered pumps, such as the fuel transfer pump 17 and the high pressure pump 20, are generally considered more efficient and more reliable than electrically powered pumps for larger engines. Mechanically-powered pumps are more efficient because they utilize energy already created directly by the engine 11. Specifically, in relatively large engines, such as those used in conjunction with generators, boats, and locomotives, the fuel transfer pump 17 must be relatively powerful to circulate fuel through the large fuel system. Thus, an electrically powered fuel transfer pump used in these engines could be especially inefficient and costly.

In addition, the present invention is advantageous because the method of priming around the fuel transfer pump 20 is electronically controlled. Thus, the state of the fuel system 10 can be monitored even when the engine 11 is inactive to assure that the engine 11 can start without unreasonable delay. In addition to delay in engine cranking times being an annoyance, unreasonably long engine cranking times can be detrimental in emergencies. For instance, an engine used with a generator may remain inactive for a long period of time. However, if the primary power source fails, the generator may have a limited to time to restore power without detrimentally affecting those whom the power is serving.

The present invention can assure that the fuel system is primed for such an emergency.

It should be understood that the above description is intended for illustrative purposes only, and is not intended to limit the scope of the present invention in any way. Thus, those skilled in the art will appreciate that other aspects, objects, and advantages of the invention can be obtained from a study of the drawings, the disclosure and the appended claims.

What is claimed is:

1. A fuel system comprising:

a first fuel pump being electrically powered and in communication with an electronic control module;

a second fuel pump being operably coupled to an engine; and the electronic control module including a priming algorithm being operable to activate the first fuel pump when the fuel system is in an unprimed state, and the priming algorithm including an inactive engine mode.

2. The fuel system of claim 1 wherein the priming algorithm includes an engine activation mode and the inactive engine mode.

3. The fuel system of claim 1 including a common rail being fluidly connectable to at least one fuel injector; and the first fuel pump being in fluid communication with the common rail via a bypass line, which is free of any pump, when the fuel system is in the unprimed state.

4. The fuel system of claim 1 including at least one fuel system condition sensor being in communication with the electronic control module.

5. The fuel system of claim 4 wherein the at least one fuel system condition sensor including a pressure sensor upstream from the second fuel pump.

6. The fuel system of claim 1 including a third pump being positioned upstream from the second pump and being operably coupled to the engine.

7. The fuel system of claim 6 wherein the priming algorithm being operable to de-activate the first fuel pump when the fuel system is in a primed state.

8. The fuel system of claim 7 wherein the first fuel pump being a priming pump, the second fuel pump being a high pressure pump, and the third fuel pump being a fuel transfer pump;

the priming pump being in fluid communication with a common rail via at least one of a bypass line around the high pressure pump and through the high pressure pump when the fuel system is in the unprimed state, and the fuel transfer pump being in fluid communication with the common rail via the high pressure pump when the fuel system is in a primed state;

the priming algorithm including an engine activation mode and the inactive engine mode; and the electronic control module being in communication with a pressure sensor upstream from the high pressure pump.

9. A control system, comprising:

at least one sensor operable to sense a state of the fuel system of an engine;

an electronic control module being in communication with the at least one sensor and including a priming algorithm; and the priming algorithm being operable to activate an electrically powered fuel pump when the state of the fuel system is unprimed, the engine is inactive and the priming algorithm is in an inactive engine mode.

10. The control system of claim 9 wherein the priming algorithm being operable to de-activate the electrically powered fuel pump when the fuel system is in a primed state.

11. The control system of claim 10 wherein the at least one sensor includes a pressure sensor upstream from a high pressure pump.

12. The control system of claim 11 wherein the priming algorithm includes a comparing algorithm being operable to compare a sensed upstream pressure with a predetermined upstream pressure.

13. The control system of claim 12 wherein the priming algorithm includes an engine activation mode and the inactive engine mode.

14. A method of priming a fuel system of an engine, comprising the steps of:

determining whether the engine is activated;

determining whether the fuel system is in an unprimed state; and if the fuel system is in the unprimed state, and the engine is inactive, then activating an electrically powered fuel pump via an electronic control module.

15. The method of claim 14 including a step of circulating fuel, at least in part, by bypassing a second pump operably coupled to an engine when the fuel system is in an unprimed state.

16. The method of claim 15 wherein the step of determining includes a step of sensing a pressure upstream from the second pump.

17. The method of claim 16 wherein the step of determining includes a step of comparing the sensed upstream pressure with a predetermined upstream pressure.

18. The method of claim 14 including a step of, if the fuel system is in a primed state, de-activating the electrically powered fuel pump.

19. The method of claim 18 including a step of determining whether the fuel system is in the primed state, at least in part, by sensing at least one of pressure upstream from the high pressure pump, pressure downstream from the high pressure pump, engine speed and air starter condition.

20. The method of claim 18 including a step of operably coupling a third pump to an engine.

* * * * *